US006100774A

United States Patent [19]

Cox et al.

[11] Patent Number: 6,100,774

[45] Date of Patent: Aug. 8, 2000

[54] HIGH UNIFORMITY MICROSTRIP TO MODIFIED-SQUARE-AX INTERCONNECT

[75] Inventors: Gerald A. Cox, Playa Del Rey; Brian T. McWhirter, Redondo Beach; Joseph S. Wong, Upland; Robert G. Yaccarino, Redondo Beach; Steve E. Bradshaw, West Hills; Peter J. Holbrook, Westchester, all of Calif.

[73] Assignee: Raytheon Company, Lexington, Mass.

[21] Appl. No.: 09/126,869

[22] Filed: Jul. 31, 1998

[51] Int. Cl.[7] ..... H01P 5/08

[52] U.S. Cl. ..... 333/33; 333/260

[58] Field of Search ..... 333/33–35, 260

[56] References Cited

U.S. PATENT DOCUMENTS

| | | | |
|---|---|---|---|
| 4,611,186 | 9/1986 | Ziegner | 333/33 X |
| 4,724,409 | 2/1988 | Lehman | 333/260 |
| 5,394,119 | 2/1995 | Pleva et al. | 333/260 X |
| 5,508,666 | 4/1996 | Nguyen | 333/33 |

OTHER PUBLICATIONS

Microwaves, Apr. 1968, pp. 52–56, "Why Not Use Rectangular Coax?", W. S. Metcalf.

*Primary Examiner*—Paul Gensler

*Attorney, Agent, or Firm*—Leonard A. Alkov; Glenn H. Lenzen, Jr.

[57] ABSTRACT

A very low reflection transition with tightly controlled variability between a rectangular coaxial transmission line and a microstrip transmission line. The microstrip ground plane is extended under the transition region to form the transition ground plane. The upper portion of the dielectric of the rectangular coaxial transmission line is removed at the transition region, together with the upper portion of the center conductor. The spacing between the transition center conductor and the ground plane is reduced in relation to the spacing between the rectangular coaxial line center conductor and outer conductive shield. A tuning cavity is formed in the transition ground plane beneath the transition center conductor.

16 Claims, 6 Drawing Sheets

HIGH UNIFORMITY MICROSTRIP TO MODIFIED-SQUARE-AX INTERCONNECT

TECHNICAL FIELD OF THE INVENTION

This invention relates to RF transmission line, and more particularly to a very low reflection transition (interconnect) with tightly controlled variability between modified square-ax and microstrip transmission lines.

BACKGROUND OF THE INVENTION

Two common types of microwave transmission lines are coaxial transmission lines and microstrip transmission lines. A special type of coaxial line is known as rectangular coaxial line. In this type of line, an outer conductor shield having a rectangular cross-sectional configuration is used instead of an outer conductor shield with a circular cross-section which is used for conventional coaxial line. The inner conductor for rectangular coaxial line can also have either a rectangular cross-section or a circular cross-section. Rectangular coaxial lines are described, for example, in *Microwaves,* April, 1968, pp. 52–56, "Why Not Use Rectangular Coax?", W. S. Metcalf.

One type of rectangular coaxial transmission line is known as "modified square-ax"; it is a rectangular transmission line with a square outer conductor and a round inner conductor separated by a dielectric material.

It is desirable for some applications to use more than one type of transmission lines to interconnect individual circuits or devices for signal propagation. There is therefore a need to provide a transition between circuits or devices which include different types of transmission lines, and particularly between modified square-ax and microstrip transmission lines. One problem is the significant mismatch encountered at the interface between the two transmission lines due to the physical discontinuity. Many RF applications require transitions between different transmission line configurations/media with a minimum reflection of energy.

SUMMARY OF THE INVENTION

A microwave circuit is described, which includes a rectangular coaxial transmission line section, a microstrip transmission line section, and a wideband transition section electrically interconnecting the rectangular coaxial section and the microstrip section. The rectangular coaxial transmission line section includes a rectangular dielectric member having a rectilinear cross-sectional configuration, a center conductor extending through an opening formed in the dielectric member and an outer conductive shield disposed around the outer periphery of the dielectric member and comprising opposed top and bottom wall portions and opposed first and second side wall portions, such that there is a first separation distance between the center conductor and the bottom wall portion of the shield. The microstrip transmission line section includes a dielectric substrate having a microstrip conductor line defined on a first surface of the substrate and a microstrip ground plane adjacent to the second surface of the substrate. The microstrip conductor line is spaced by a second separation distance from the microstrip conductor line. The wideband transition section electrically connects the rectangular coaxial transmission line section and the microstrip transmission line section, and includes a transition conductive element in electrical contact between the rectangular coaxial line center conductor and the microstrip conductor line, a transition ground plane, and a transition dielectric layer having a thickness less than the first separation distance. The transition substrate layer is disposed between the transition conductive element and the transition ground plane.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
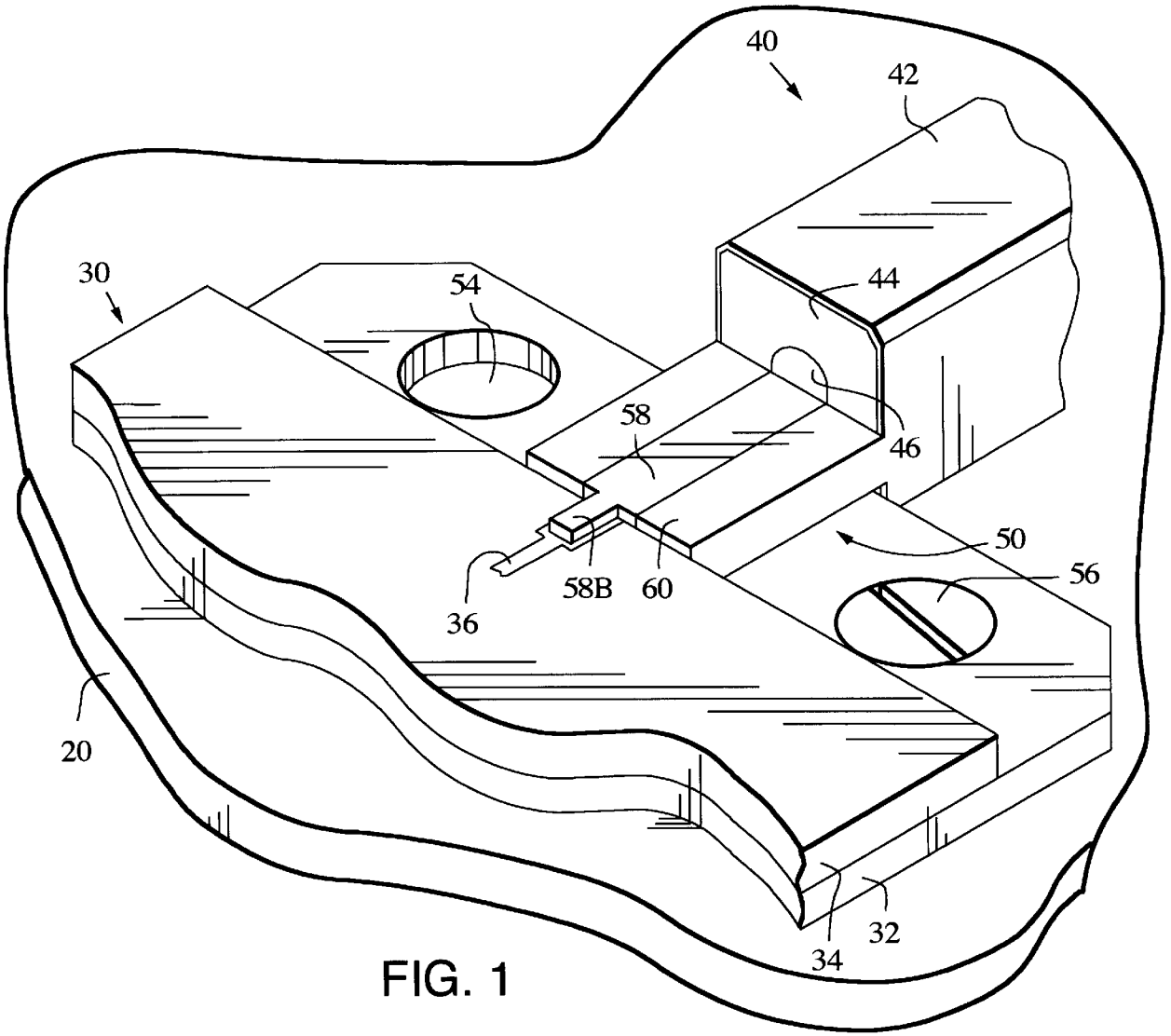
FIG. 1 is an isometric view of a transition between a modified square-ax transmission line and a microstrip transmission line in accordance with the invention.
Figure 4:
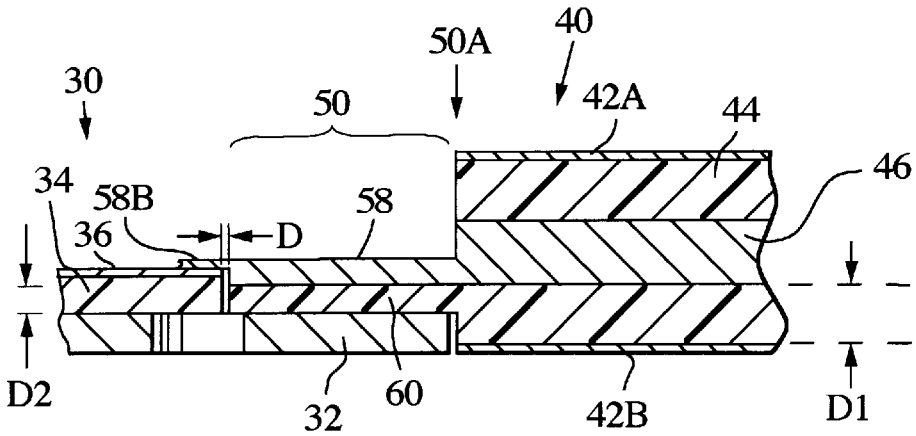
FIG. 4 is a horizontal longitudinal cross-section view taken along line 4—4 of FIG. 3.
Figure 5:
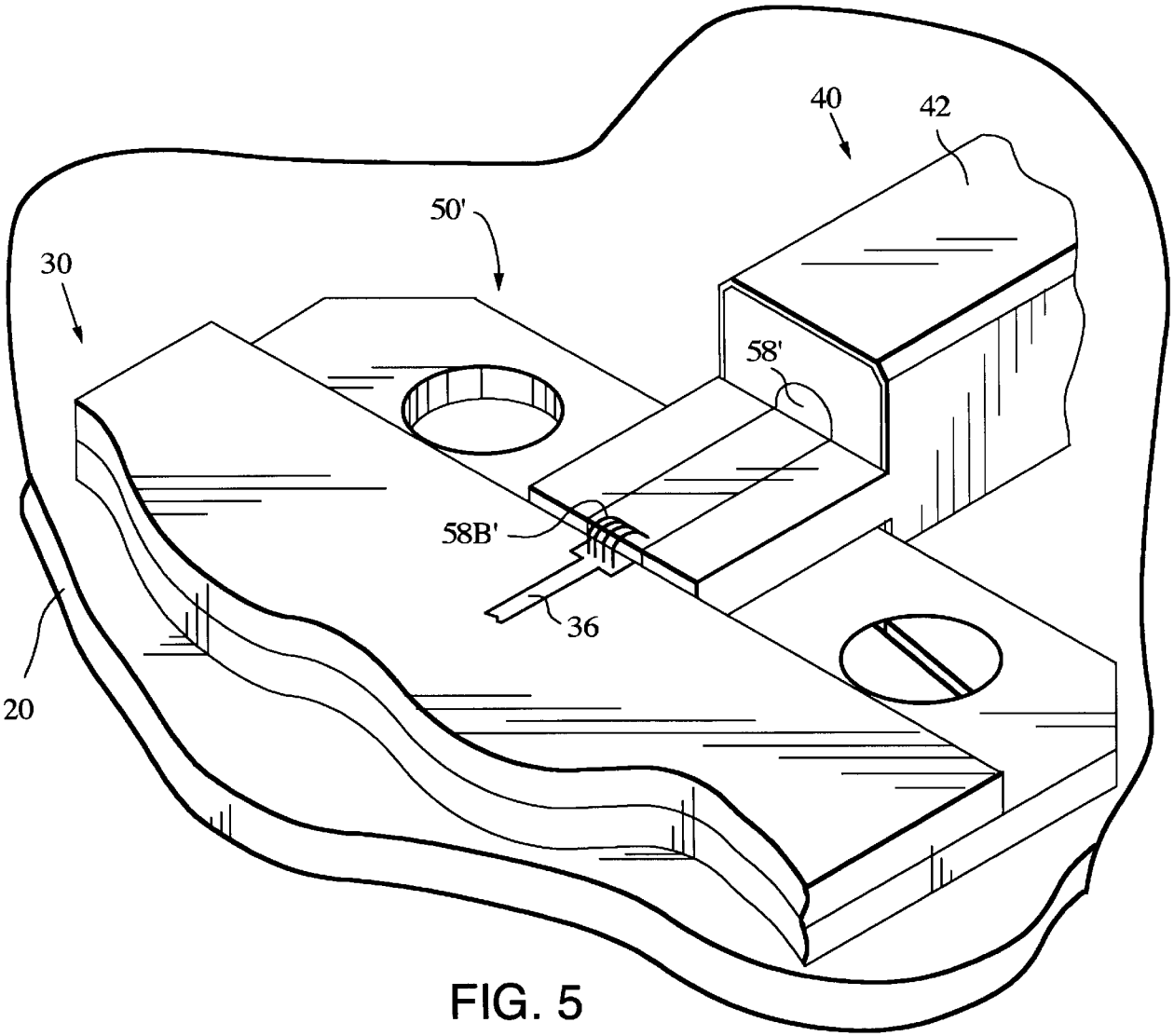
FIG. 5 is an isometric view of an alternate embodiment of a transition between a modified square-ax transmission line and a microstrip transmission line in accordance with the invention.
Figure 6:
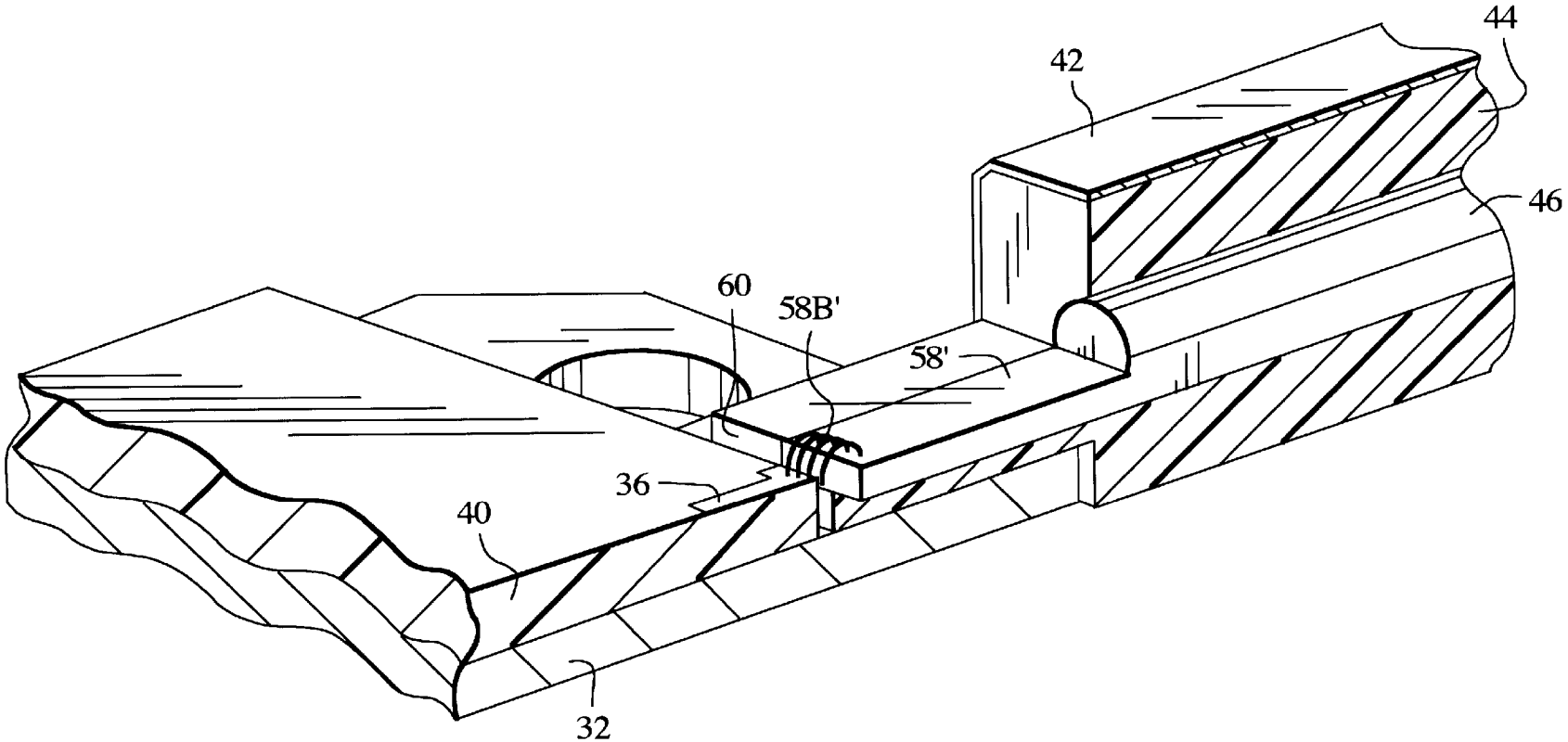
FIG. 6 is a cut-away view of the transition of FIG. 5.
Figure 7:
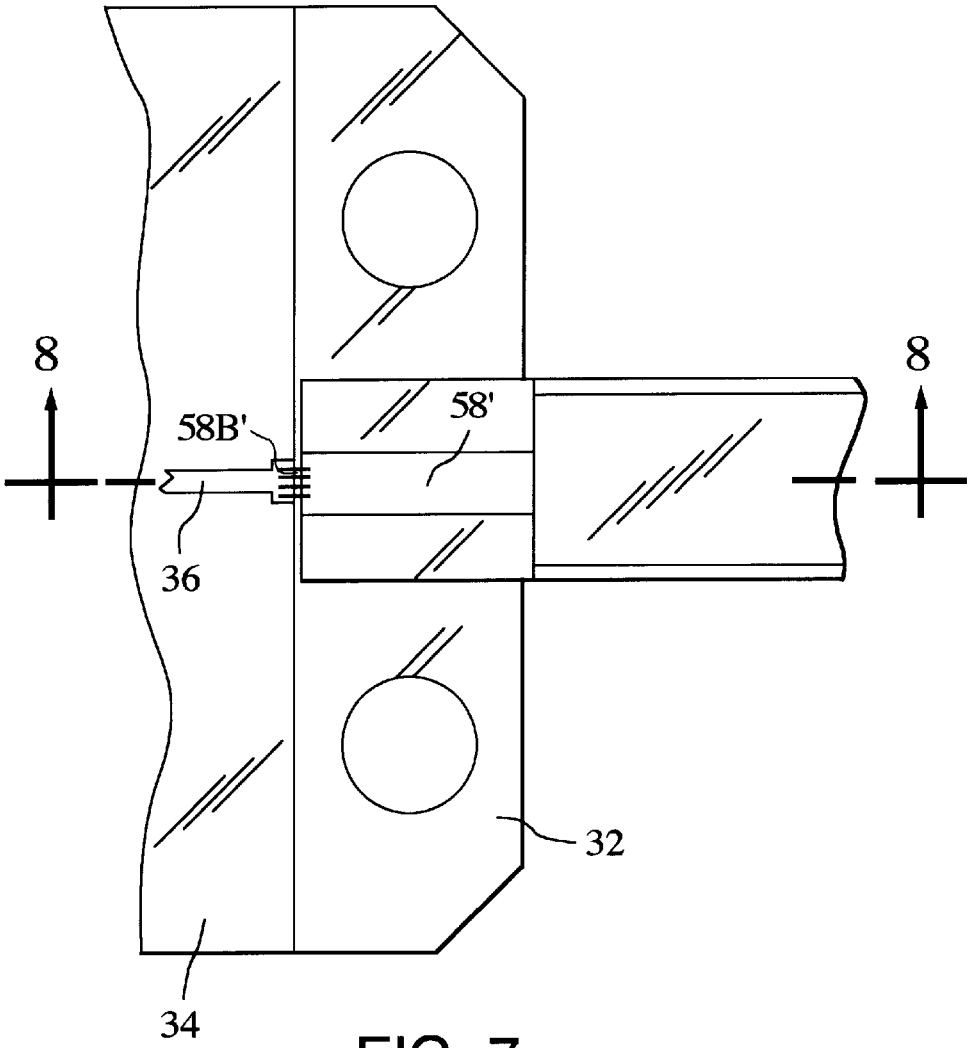
FIG. 7 is a top view of the transition of FIG. 5.
Figure 8:
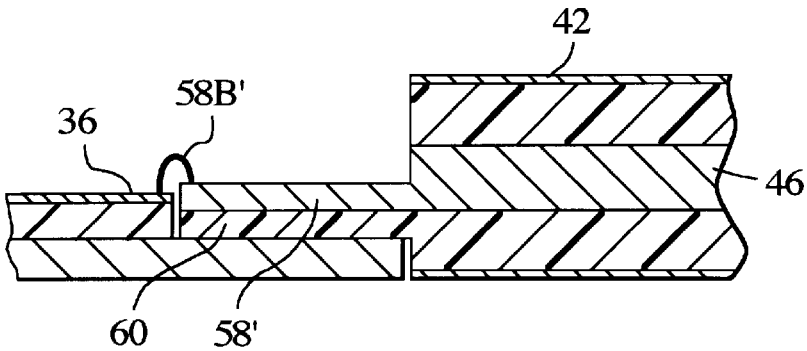
FIG. 8 is a horizontal longitudinal cross-section view taken along line 8—8 of FIG. 7.

FIG. 1 is an isometric view showing a microstrip transmission line 30, a modified square-ax transmission line 40, and a microstrip to modified square-ax transition 50 in accordance with the invention. The microstrip transmission line 30 includes a ground plane formed by a metal carrier 32, a dielectric substrate 34, and a microstrip conductor or trace 36. In this exemplary embodiment, the substrate 34 is 30 mils (0.030 inch) thick, and is a typical dielectric having a dielectric constant ($\in_R$) greater than 10, e.g. 15.4. The dielectric substrate 34 may or may not be plated in the conventional manner with a conductive layer of copper or other metal, but it must be in intimate electrical contact with the carrier 32. If the dielectric substrate 34 is plated, a conductive epoxy or solder is used to make electrical contact with the carrier. If the substrate is not plated, the dielectric is attached to the carrier using a non-conductive adhesive, and the carrier provides the ground path. In this exemplary embodiment, the substrate 34 has a thickness of 30 mils, so that the conductor 36 is spaced from the ground plane by the same dimension, or separation distance D2 (FIG. 4). The microstrip conductor 36 is defined on the top surface of the substrate 34.

Figure 3:
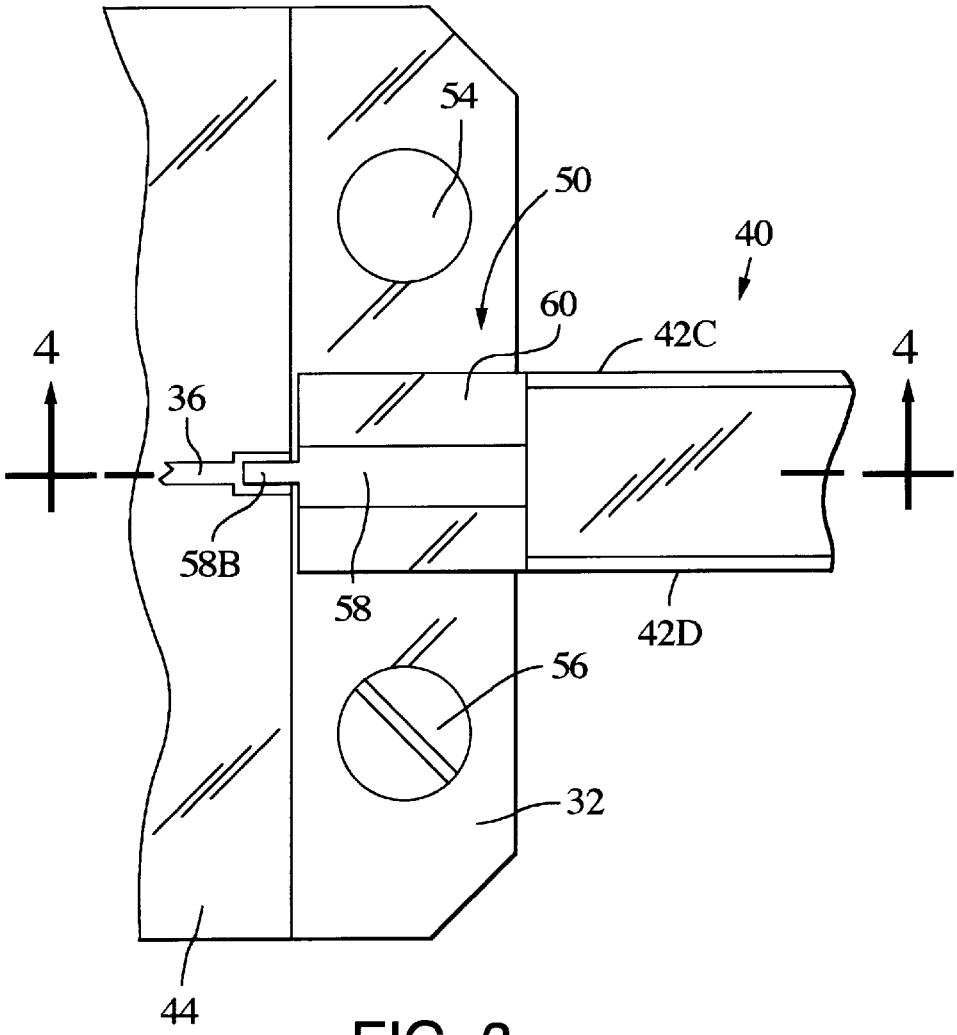
FIG. 3 is a top view of the transition of FIG. 1.

The modified square-ax transmission line ("MSTL") 40 includes an outer conductor shield 42, a square-ax dielectric 44 and an inner conductor 46 having a circular cross-sectional configuration. In this exemplary embodiment, the MSTL 40 is 0.114 inch wide by 0.114 inch high, and the dielectric 44 has a dielectric constant ($\in_R$) less than 5, e.g. 2.6. Since the MSTL 40 has a rectangular cross-sectional configuration, the outer conductor 42 includes a top wall portion 42A, a bottom wall portion 42B, and side wall portions 42C and 42D (FIGS. 3 and 4). The carrier 32 of the microstrip transmission line 30 extends under the MSTL 40 at the transition region, thereby forming part of the outer conductor of the MSTL in the transition section and changing the separation distance between the inner and outer conductors 46, 42, respectively of the MSTL. In particular, as shown in FIG. 4, the separation distance D1 between the coaxial center conductor 46 and the bottom wall portion 42B of the MSTL outer conductor 42 is reduced to distance D2 at the transition 50. In this exemplary embodiment, D1 =40 mils (0.040 inch), D2=30 mils (0.030 inch), and the carrier 32 has a thickness of at least D1–D2, and is fabricated from a conductive metal, e.g. steel or aluminum.

The transition 50 includes a center conductor 58 and a dielectric structure 60. These are defined, in this exemplary embodiment, from extended, modified portions of the corresponding dielectric and center conductor structures of the MSTL 40. The carrier 32 extends under the transition 50, and serves as the groundplane for the transition. Thus, in the transition region, the bottom wall portion 42B of the outer conductor 42 terminates at transition edge 50A. The top conductor 42A in this embodiment terminates at the transition edge 50A. The upper half of the dielectric material 44 between the inner and outer conductors of the MSTL is removed over the area of the transition 50 where the carrier 32 extends under the transition 50 (FIGS. 1 and 3), and a lower portion is removed to provide the reduced separation distance D2 between the transition conductor 58 and the carrier 32, to define the transition dielectric structure 60. This form of the transition dielectric structure further confines the electric field lines to the bottom half of the MSTL dielectric 44 in the transition region.

The transition 50 has no conductive side walls, in this exemplary embodiment. In other embodiments, side walls can be employed in the transition, and these walls could be reduced height commensurate with the height of the transition dielectric, or of a tapered height, running from the height of the MSTL at edge 50A to the height of the dielectric of the transition, or of some other height.

Figure 2:
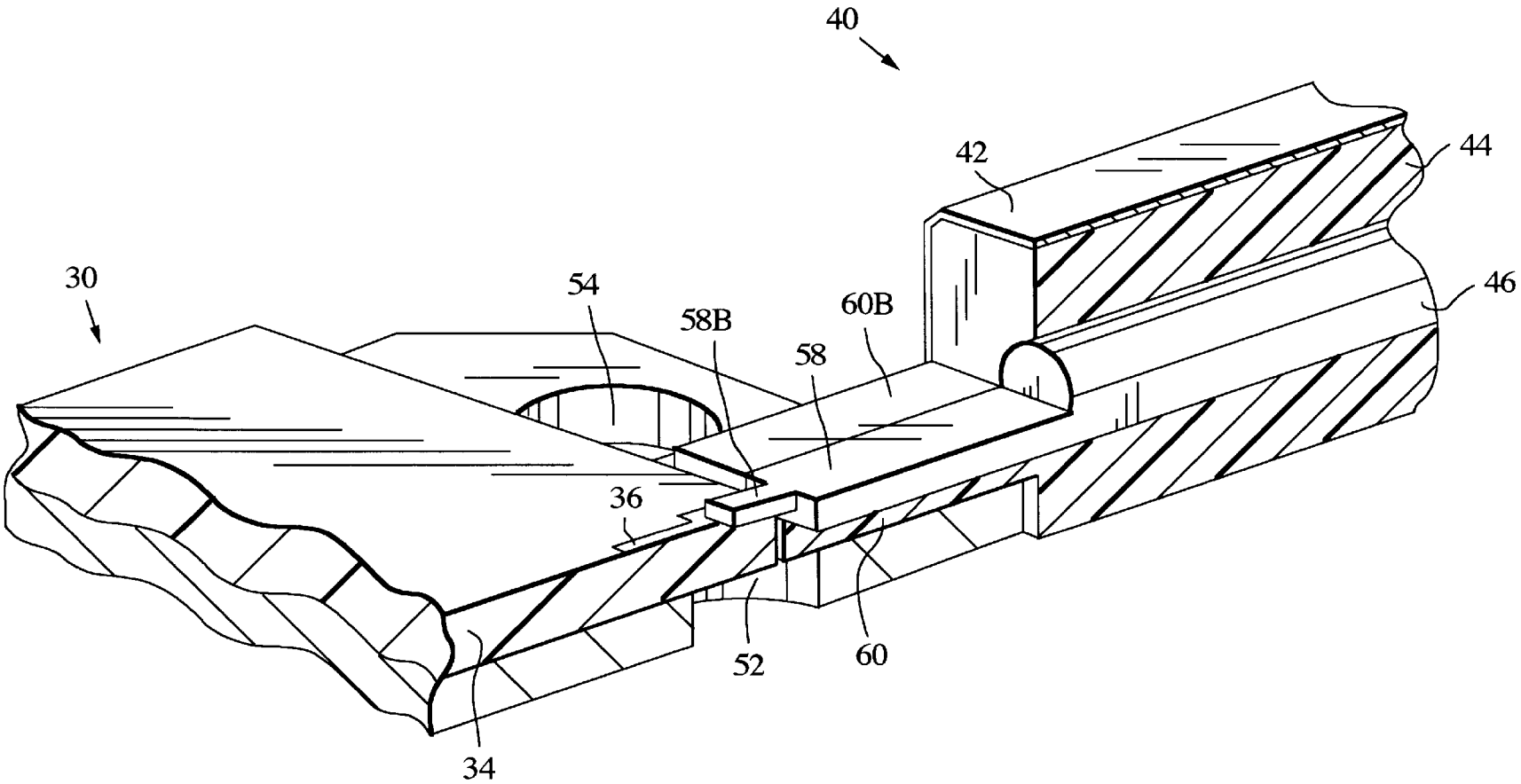
FIG. 2 is a cut-away view of the transition of FIG. 1.

The center conductor 46 of the MSTL 40 and the center conductor 58 of the transition 50 constitute a single piece of metal in this exemplary embodiment, which is machined to provide the shape of these conductor portions 46, 58. As shown in FIG. 2, the center conductor 46 is of circular cross-section, and the center conductor 58 has a rectangular cross-section. For the exemplary embodiment, for operation over a frequency range of 2 GHz to 20 GHz, the center conductor 46 has a diameter of 0.054 inch inches, and the center conductor 58 is 0.58 inch wide by 0.005 inch high.

A conductive plate 20 is positioned beneath the entire assembly, as shown in FIG. 1, in this exemplary embodiment. (For clarity, the plate 20 is not shown in FIGS. 2–4.) The carrier 32 and the bottom wall 42B of the MSTL 40 are in contact with this plate. The plate 20 can alternatively serve as the bottom wall 42B. The outer conductive shielding of the MSTL 40 can alternatively be provided by the walls of a conductive channel formed in a housing. Screw holes 54 are machined into the carrier, and receive screws 56 which engage the bottom plate 20 to insure continuity of the electrical ground path between the microstrip and the MSTL. Alternatively, the carrier 32 can be conductively bonded to the plate 20, instead of screw fastening.

The upper half of the coaxial center conductor 46 is also removed, e.g. by machining, in the area of the transition 50, to define the transition center conductor 58, as shown in FIGS. 1–3. This removal concentrates the electromagnetic fields. Thus, the top surface of the transition center conductor is flush with the top surface 60B of the transition dielectric, but has a rectangular cross-sectional configuration.

The end of the transition 50 is positioned at a small spacing or gap distance D (FIG. 4) from the edge of the microstrip substrate. In this embodiment, the transition 50 has a length of about one quarter wavelength, and the gap distance D is about 0.008 inch.

The tip 58B of the transition conductor 58 extends in a cantilevered fashion over the adjacent end of the microstrip conductor 36, and is electrically connected to the conductor 36, e.g. by soldering. A pocket or cavity 52 is machined into the carrier 32 of the microstrip line 30, directly beneath the connection between the tip 58B of the transition conductor 58 and the microstrip trace 36. This pocket provides an RF tuning function (See FIG. 2). The pocket has a diameter in the range of 0.030 inch to 0.040 inch in this exemplary embodiment.

The characteristic impedances of the three lines are designed to be approximately equal, e.g. 50 ohms in this example. However, there would still be a large reflection at the transitions between the different type of transmission lines due to the changes in electric field configuration for each type of transmission line used in this exemplary embodiment of the MSTL 40/transition 50 and the microstrip 30. The electromagnetic field of the MSTL 40 is generally symmetric about the center axis, and so the transition 50 forces the field to the bottom half of the transition, which is more compatible with the electromagnetic field of the microstrip line 30. Moreover, the fields spread into the cavity 52, and then enter the microstrip, thus further matching the field configurations. The cavity 52 as well as other features of the system provide tuning to cancel capacitances or inductances that are introduced as a result of connecting 50 ohm lines of different types. These tuning features center the frequency response of the transition on the Smith chart about Z=50 ohms, which makes the system very insensitive to dimensional variations. The combined effect of the cavity, the field matching, and the separation gap D (FIG. 4) of the dielectrics 34 and 60 is to substantially lower the reflection of RF energy by the transition 50 and also make the transition relatively insensitive to fabrication, material, or assembly tolerances.

FIGS. 5–8 illustrate a second embodiment of a transition 50' between a microstrip line 30 and an MSTL 40. This embodiment is similar to transition 50 shown in FIGS. 1–4, but is without a tuning cavity 52. Also, the cantilevered tab 58B of the transition 50 is replaced with a wire or ribbon bonds connection 58B'. The field matching in this alternate embodiment is achieved by adjusting the wire/ribbon bond lengths and the number of wire bonds used.

The transition according to this invention provides a very low reflection, while controlling the variability of the reflection coefficient over frequency from one transition to the next. Any application that requires microstrip to modified square-ax microwave transitions with highly reproducible characteristics over the frequency band could make use of this transition.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A microwave circuit, comprising:

a rectangular coaxial transmission line section including a rectangular dielectric member having a rectilinear cross-sectional configuration, a center conductor extending through the dielectric member and an outer conductive shield disposed around the outer periphery of the dielectric member and comprising opposed top and bottom wall portions and opposed first and second side wall portions, such that there is a first separation distance between the center conductor and the bottom wall portion of the shield;

a microstrip transmission line section including a dielectric substrate having a microstrip conductor line defined on a first surface of the substrate and a microstrip ground plane adjacent a second surface of the substrate, the microstrip conductor line spaced by a second spaced distance from the microstrip ground plane;

a wideband transition section for electrically connecting the rectangular coaxial transmission line section and the microstrip transmission line section, said transition section including a transition conductive element in electric contact between the coaxial center conductor and the microstrip conductor line, a transition ground plane, and a transition dielectric layer having a thickness less than said first separation distance, said substrate layer disposed between said transition conductive element and said transition ground plane; and a tuning cavity formed in said microstrip ground plane and said transition ground plane under a connection between said microstrip conductor line and said transition conductive element.

2. The circuit of claim 1 wherein said transition conductive element includes a cantilevered tab portion extending over an end portion of the microstrip conductor line, said tab portion electrically connected to said end portion.

3. The circuit of claim 1 wherein said transition conductive element includes a wire bond connected to the microstrip conductor line.

4. The circuit of claim 1 wherein said microstrip ground plane is defined by a planar conductive carrier structure having a minimum thickness equal to the difference between the first separation distance and the second separation distance.

5. The circuit of claim 4 wherein said transition ground plane is defined by a unitary extension of said carrier structure.

6. The circuit of claim 1 wherein said center conductor of said rectangular coaxial transmission line section and said transition conductive element constitute portions of a single unitary conductive element.

7. The circuit of claim 6 wherein said center conductor has a circular cross-section configuration, and said transition conductive element has a rectangular cross-section configuration.

8. The circuit of claim 1 wherein said dielectric substrate is fabricated of a dielectric material having a relative dielectric constant greater than 10, and said rectangular dielectric member and said transition dielectric layer are fabricated from a dielectric material having a relative dielectric constant less than 5.

9. The circuit of claim 1 wherein said microstrip ground plane is defined by a planar conductive carrier structure, said transition ground plane is defined by a unitary extension of said carrier structure, and said tuning cavity is defined in said carrier structure.

10. A microwave circuit, comprising:

a rectangular coaxial transmission line section including a rectangular dielectric member having a square cross-sectional configuration, a center conductor having a circular cross-sectional configuration extending through the dielectric member and an outer conductive shield disposed around the outer periphery of the dielectric member and comprising opposed top and bottom wall portions and opposed first and second side wall portions, such that there is a first separation distance between the coaxial center conductor and the bottom wall portion of the shield;

a microstrip transmission line section including a planar dielectric substrate having a microstrip conductor line defined on a first surface of the substrate and a microstrip ground plane adjacent a second surface of the substrate, the microstrip conductor line spaced by a second spaced distance from the microstrip conductor line;

a wideband transition section for electrically connecting the rectangular coaxial transmission line section and the microstrip transmission line section, said transition section including a transition conductive element in electric contact between the center conductor and the microstrip conductor line, a transition ground plane, and a planar transition dielectric layer having a thickness less than said first separation distance, said substrate layer disposed between said transition conductive element and said transition ground plane; and wherein said microstrip ground plane is defined by a planar conductive carrier structure having a minimum thickness equal to the difference between the first separation distance and the second separation distance, and said transition ground plane is defined by a unitary extension of said carrier structure.

11. The circuit of claim 10 further comprising a tuning cavity formed in said carrier structure under a connection between said microstrip conductor line and said transition conductive element.

12. The circuit of claim 10 wherein said transition conductive element includes a cantilevered tab portion extending over an end portion of the microstrip conductor line, said tap portion electrically connected to said end portion.

13. The circuit of claim 10 wherein said transition conductive element includes a wire bond connected to the microstrip conductor line.

14. The circuit of claim 10 wherein said center conductor of said rectangular coaxial transmission line section and said transition conductive element constitute portions of a single unitary conductive element.

15. The circuit of claim 10 wherein said dielectric substrate is fabricated of a dielectric material having a relative dielectric constant greater than 10, and said rectangular dielectric member and said transition dielectric layer are fabricated from a dielectric material having a relative dielectric constant less than 5.

16. A microwave circuit, comprising:

a rectangular coaxial transmission line section including a rectangular dielectric member having a rectilinear cross-sectional configuration, a center conductor extending through the dielectric member and an outer conductive shield disposed around the outer periphery of the dielectric member and comprising opposed top and bottom wall portions and opposed first and second side wall portions, such that there is a first separation distance between the center conductor and the bottom wall portion of the shield;

a microstrip transmission line section including a dielectric substrate having a microstrip conductor line defined on a first surface of the substrate and a microstrip ground plane adjacent a second surface of the substrate, the microstrip conductor line spaced by a second spaced distance from the microstrip ground plane; and a wideband transition section for electrically connecting the rectangular coaxial transmission line section and the microstrip transmission line section, said transition section including a transition conductive element in electric contact between the coaxial center conductor and the microstrip conductor line, a transition ground plane, and a transition dielectric layer having a thickness less than said first separation distance, said substrate layer disposed between said transition conductive element and said transition ground plane, said transition conductive element including a cantilevered tab portion extending over an end portion of the microstrip conductor line, said tab portion electrically connected to said end portion.

* * * * *